United States Patent [19]

Munschy

[11] 4,136,468

[45] Jan. 30, 1979

[54] FOOTWEAR

[76] Inventor: Dorothy G. Munschy, 1512 Locust Ravine, Bakersfield, Calif. 93306

[21] Appl. No.: 879,096

[22] Filed: Feb. 21, 1978

[51] Int. Cl.[2] ..... A43B 3/26

[52] U.S. Cl. ..... 36/97

[58] Field of Search ..... 36/97, 107, 50

[56] References Cited

U.S. PATENT DOCUMENTS

| | | | |
|---|---|---|---|
| 2,523,449 | 9/1950 | Rosenzweig | 36/97 |
| 3,142,911 | 8/1964 | Waters | 36/97 |

FOREIGN PATENT DOCUMENTS

| | | | |
|---|---|---|---|
| 2258138 | 8/1975 | France | 36/97 |

*Primary Examiner*—Patrick D. Lawson

*Attorney, Agent, or Firm*—Huebner & Worrel

[57] ABSTRACT

Improved footwear comprising a flexible cover component for a human foot including a sole portion, an upper portion integrally related with the sole portion including a toe section for defining a cavity adapted to receive a human foot, a pair of side sections extended rearwardly from the toe section, a heel tab integrally related to the rearward section of the sole portion and extended upwardly therefrom for confining the heel of the foot, and a flexible binder component for securing the cover component about the foot including a strap united with the heel tab and adapted to be united with the toe section employing Velcro fasteners and the like.

7 Claims, 8 Drawing Figures

FOOTWEAR

BACKGROUND OF THE INVENTION

1. Field of the Invention

The invention generally relates to footwear and more especially to an improved cover of a variable size particularly suited for use in hospitals, research facilities, gymnasiums, restaurants, aircraft and other environments in which a use of ordinary street shoes is impossible, impractical or is to be avoided, and disposability of soiled and/or contaminated footwear is desirable.

2. Description of the Prior Art

The prior art, of course, is replete with shoes adapted to be adjusted in size for various purposes. For example, attention is invited to U.S. Pat. No. 3,762,075 which issued Oct. 2, 1973 to Dorothy G. Munschy as well as to prior art reference patents cited during the prosecution of the application upon which the Munschy patent issued.

As disclosed in U.S. Pat. No. 3,762,075, there is a relatively large number of circumstances under which it is desirable to provide covering for feet, other than street shoes. Additionally, in orthopedics and pediatry and the like, as well as in other medical fields, it often is necessary to provide a protective, short term wear cover for bandages employed in swathing feet following injury, surgery and the like.

While the disposable shoe disclosed and claimed in the aforementioned U.S. patent to Munschy generally fulfills the requirements for which it was intended, it can be appreciated that even a further increase in simplicity is desirable. For example, the sizing of the patented disposable shoe requires manipulation of flaps along appropriate fold lines and such may, in some instances, be found objectionable to a wearer, particularly in instances where a wearer is in a generally debilitated condition such as a hospital patient following surgery and the like, and/or where time available to be devoted to such matters is likely to be limited, such as, for example, in research facilities.

It is therefore the general purpose of the instant invention to provide improved footwear which tends to overcome the aforementioned difficulties and disadvantages which attend a use of foot covers of the prior art.

OBJECTS AND SUMMARY OF THE INVENTION

It is an object of the instant invention to provide improved footwear.

Another object is to provide improved footwear comprising a cover which is economic to fabricate and simple to employ.

It is another object to provide improved footwear particularly suited for use by persons in environments in which a wearing of foot covers is desirable.

It is another object to provide improved disposable footwear particularly suited for use by patients having damaged feet requiring short or limited time wear protective covers.

It is another object to provide improved footwear fabricated from economic material adapted rapidly to be applied with minimal manipulation for facilitating use by patients in debilitated conditions.

Another object is to provide economic, improved footwear which is particularly useful by persons requiring a temporary usage of foot covers although not necessarily restricted in usage thereto since the footwear of the instant invention may be similarly useful when rendered reusable through suitable sterilization techniques.

These and other objects and advantages are realized through a provision of an improved foot cover comprising a flexible cover component including a sole portion having forward central and rearward sections arranged in contiguous coplanar relation, and upper portion integrally related with the sole portion including a toe section disposed in spaced relation with the plane of the sole portion for defining in conjunction therewith a cavity adapted to receive the human foot, a pair of side sections comprising a pair of foldable side tabs extended rearwardly from the toe section, whereby the length of the cover component may be foreshortened, and a heel portion including a foldable heel tab integrally related to the rearward section of the sole portion and extended upwardly therefrom for confining the heel of the foot, a flexible binder component for securing the cover component in place including a strap united with the heel tab and adapted to be united with the toe section of the cover component employing Velcro fasteners and the like, as will become more readily apparent by reference to the following description and claims in light of the accompanying drawings.

DESCRIPTION OF THE PREFERRED EMBODIMENTS

Turning first to FIGS. 1, 2, 3 and 7, wherein is illustrated footwear comprising a foot cover, generally designated 10, which embodies one embodiment of the instant invention, it is noted that the foot cover, when in an assemblied configuration, includes a cover component 12 for encasing a foot and a binder component 14 for securing the cover component to the encased foot. It is important to appreciate that the foot cover 10 may be employed indiscriminantly with either a right foot or a left foot and, within a practical range, may be employed for encasing feet of multiple sizes.

Figure 3:
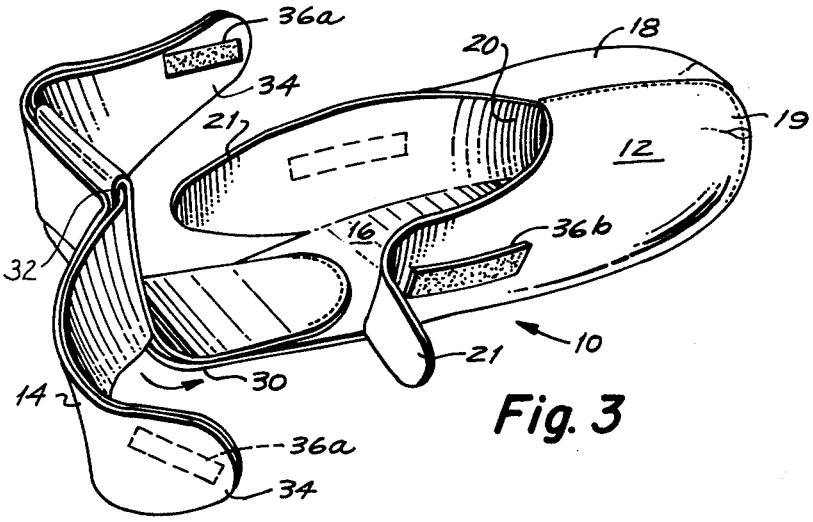
FIG. 3 is a perspective view of the foot cover shown in FIGS. 1 and 2, in an incomplete configuration.

Referring now to FIG. 3, it can be seen that the cover component 12 includes a first portion, herein referred to as a sole portion and designated 16, corresponding and having the functions generally ascribed to the sole of a shoe. Additionally, the cover component 12 includes an upper portion, designated 18, corresponding and having functions generally ascribed to the "upper" of the shoe. The upper portion 18 includes a toe section 19 which along with the sole portion forms a toe cavity 20, FIG.

3, and includes flexible side sections 21 which serve to confine a foot.

It is at this juncture important to understand that the material from which the cover 10 is fabricated is varied as desired. Of course, the specific material from which the cover 10 is fabricated is dictated, at least in part, by the particular environment in which the cover is employed. However, as currently employed the cover 10 preferably is fabricated from light-weight fabric material having the general characteristics of woven cloth.

Figure 7:
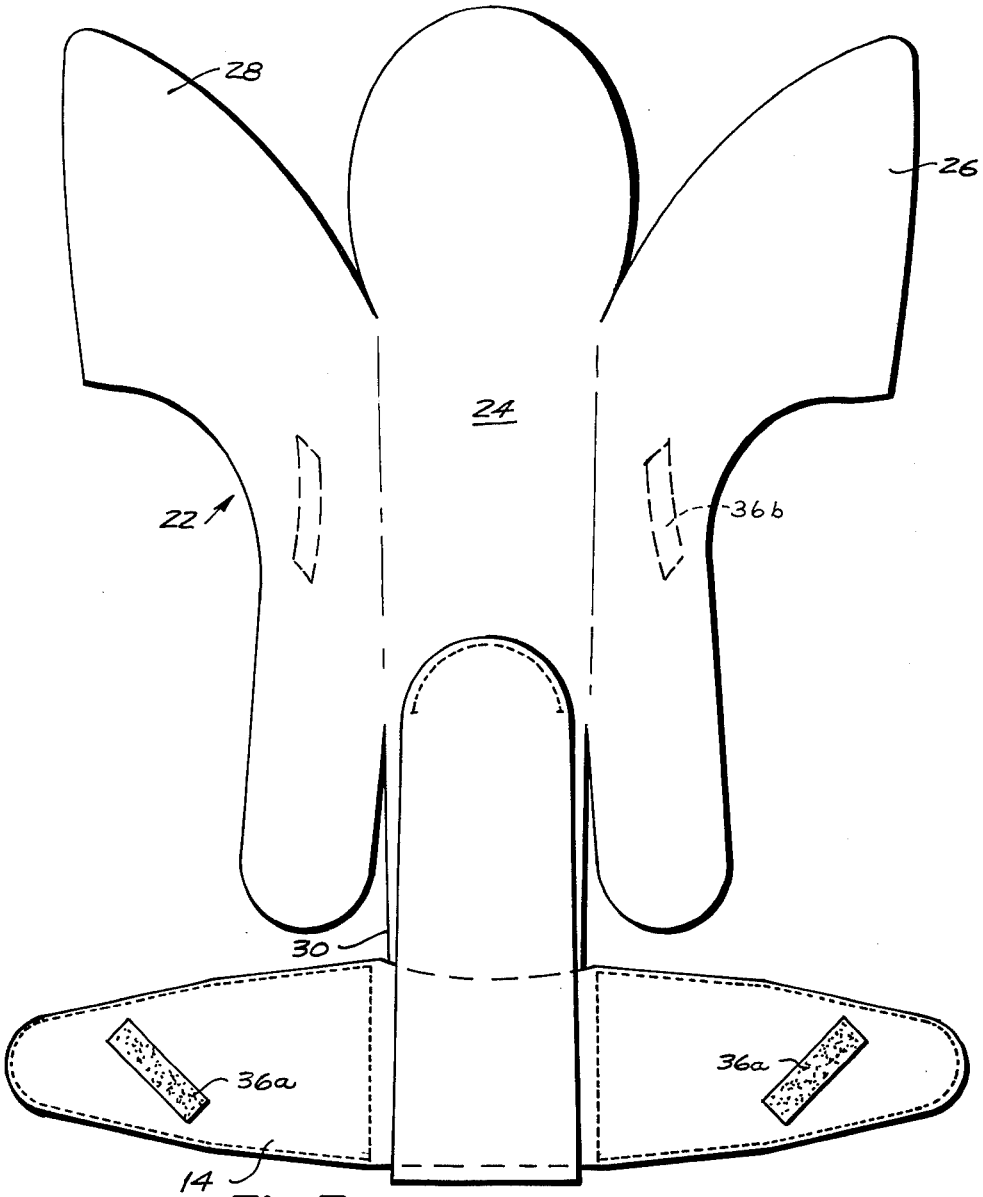
FIG. 7 is a top plan view of a blank employed in fabricating the foot cover shown in FIGS. 1, 2 and 3.

As shown in FIG. 7, a blank 22 having a central segment 24 from which extends a pair of wings, designated 26 and 28, and a heel tab 30 initially is cut from a selected material. The central segment 24 forms the sole portion 16, FIG. 3, while the wings 26 and 28 are folded into engagement and stitched together above the central segment 24 for thus forming the cavity 20 of a size and configuration suitable for receiving a foot of any one of a plurality of similar sizes. It is important to note that the wings 26 and 28 also include extended tabs which form the side sections 21, as best shown in FIG. 3.

In order to facilitate adjustment of width for the cavity 20, the wings may be secured together employing releasable fasteners such as Velcro fasteners and the like, not shown.

Figure 2:
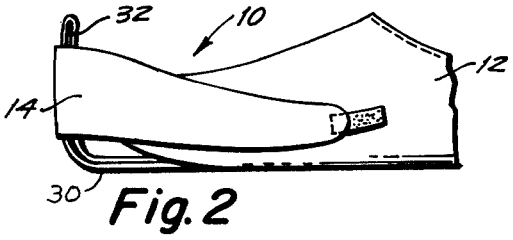
FIG. 2 is a fragmented side elevational view of the embodiment shown in FIG. 1.

Additionally, a heel tab 30 is provided as an integral part of the sole portion 16 and extends therefrom to form a loop 32, as shown in FIG. 2. The function of the loop 32, in turn, is to couple the binder component 14 to the heel tab 30. As a practical matter, the binder component 14 preferably comprises a double-layered strap 34 having one layer extended through the loop 32 and the other layer thereof passed over the outer surface of the loop, as best illustrated in FIG. 3. Consequently, the loop 32 captures the strap 34 in a manner which permits the positional relationship established therebetween to be varied. Hence, the positional relationship of the strap and the sole portion 16 of the foot cover may be varied selectively for purposes of altering the over all length of the sole portion 16 of the cover component 12.

Preferably, the opposite end portions of the strap 34 are connected to the toe section 19 employing Velcro fasteners 36. As is well known, Velcro fasteners are formed of two portions or halves, one half comprising the so-called "hook" portion, and the other half the so-called "loop" or "woolly" portion. In instances where the cover component 12 is fabricated from material having a fibrous outer surface, such as material sold under the trademark Velfoam, only one-half, or the hook portion, of a Velcro fastener need be provided for coupling the strap to the toe section of the upper portion 18. However, as shown, the Velcro fastener 36 includes a first half or hook portion **36*a* stitched to the strap and a second half or loop portion 36*b* stitched to the external surface of the toe section at an appropriate location, as indicated in FIGS. 1, 2, 3, and 7. Of course, fasteners other than Velcro fasteners 36** can be employed. For example, buttons and snaps can be employed where so desired.

Referring now to FIGS. 4, 5, 6 and 8, wherein is illustrated a further embodiment of the instant invention, there is shown footwear comprising a foot cover generally designated 40. The foot cover 40 is similar in many respects to the foot cover 10. Therefore, and for the sake of convenience, similar components are similarly numbered.

The foot cover 40, as shown in the drawings, preferably is fabricated from a material such as the commerically available, aforementioned Velfoam which is characterized by an outer fibrous surface, sometimes referred to as a "woolly" surface, to which the rigid or hook portion of a Velcro fastener may readily be attached. In such instances utilization of Velcro fasteners is greatly enhanced. However, when employing substantially frictionless material, such as Velfoam, in the interest of safety, it often is desirable to affix a friction pad, not shown, to the sole of the foot cover in order to reduce the likelihood of a wearer slipping on floor surfaces and the like.

Figure 1:
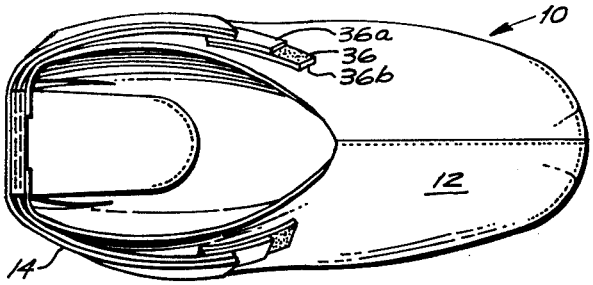
FIG. 1 is a top plan view of a foot cover comprising a first embodiment of the instant invention in a completed configuration.
Figure 5:
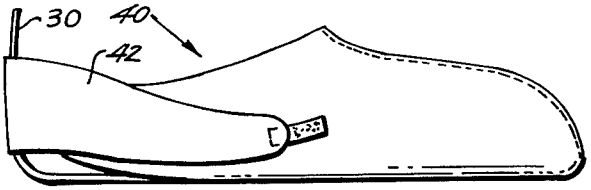
FIG. 5 is a side elevation view of the other embodiment of the instant invention.
Figure 4:
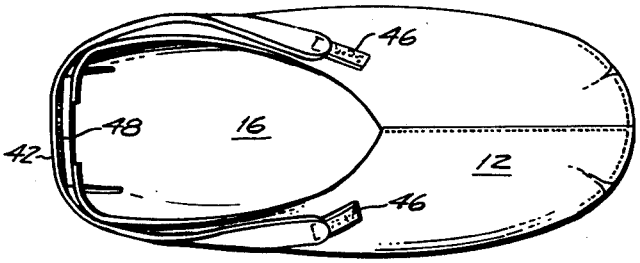
FIG. 4 is a top plan view of a foot cover comprising another embodiment of the instant invention also in a completed configuration.
Figure 6:
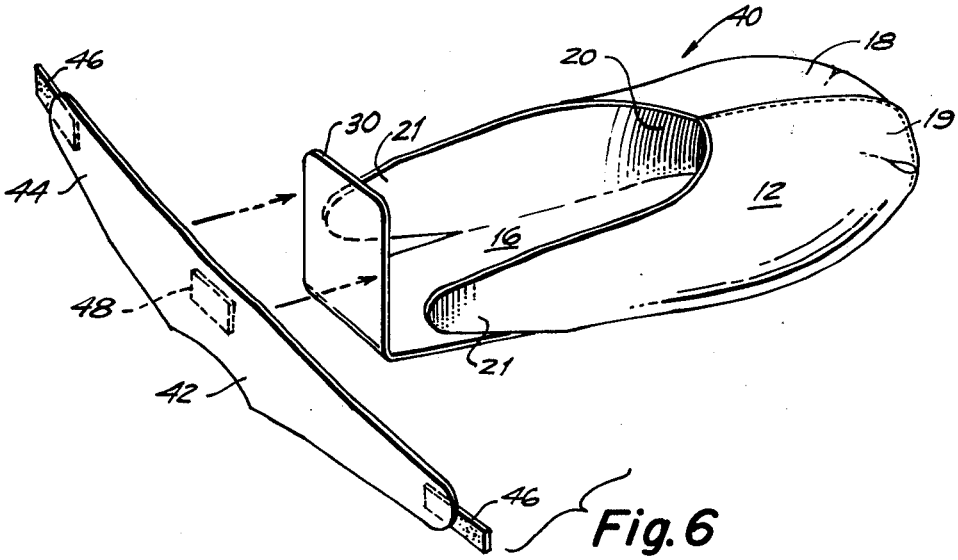
FIG. 6 is a perspective view of the embodiment shown in FIGS. 4 and 5, also in an incomplete configuration.

As shown in FIGS. 4, 5 and 6, the foot cover 40 includes a binder component 42 comprising a strap 44 having a hook portion or half of a Velcro fastener, designated 46, stitched or otherwise affixed to each of its opposite ends. Additionally, a hook portion or half of a Velcro fastener, designated 48, is stitched or otherwise affixed to the midsection of the strap 44. As a practical matter, the Velcro fastener halves 46 and 48 comprise rigid or hook valves of fasteners whereby the fasteners are particularly adapted to be releasably attached at any desired location to an adjacent woolly surface of the cover 40, including the external surfaces of the toe section 19 as well as the heel tab 30.

Figure 8:
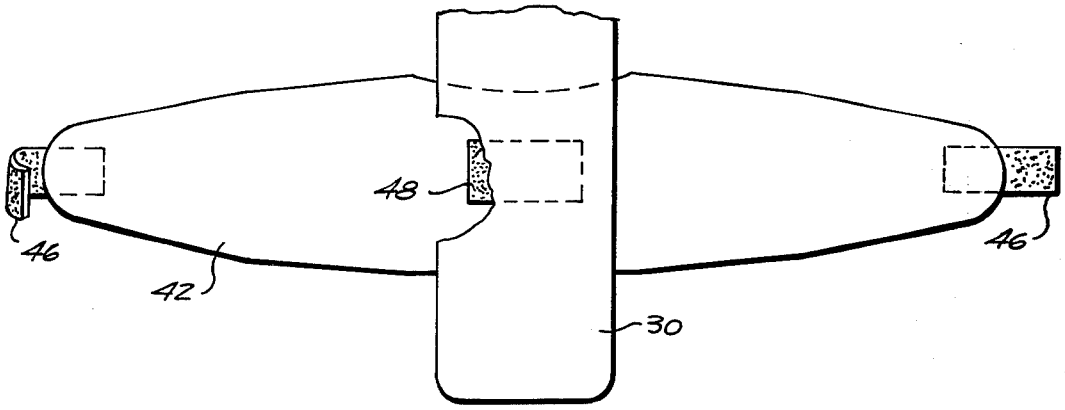
FIG. 8 is a fragmented view depicting a portion of the foot cover shown in FIGS. 4, 5 and 6, illustrating a binder component employed in securing the foot cover.

Referring for a moment to FIG. 8, it can be seen that the heel tab 30 comprises a singular foldable member which differs from the heel tab 30, as shown in FIG. 7, in that no loop is provided. Since the Velcro fastener 48 is adapted to be employed for securing the binder component 42 to the surface of the heel tab 30, the loop previously discussed may be deleted.

The foot covers 10 and 40 are each supplied in a prefabricated form, as best illustrated in FIGS. 3 and 6. In order to employ the foot covers, designated 10 and 40, a wearer simply inserts his foot into the cavity 20 leaving the heel tab 30 extended rearwardly from the sole portion 16 of the foot cover. In the event the length of the upper portion 18 of either of the foot covers 10 or 40 exceed the length of the wearer's foot, the tabs forming the side sections 21 are infolded rearwardly of the heel of the wearer and the binder component then wrapped about the wearer's ankle with the ends of the straps 34 or 44, as the case may be, being attached to the upper surface of the toe section 19 of the upper 18.

Of couse, where Velcro fasteners 36 are employed, opposite halves **36*a* and 36*b* of the Velcro fastener 36 are united. Where, however, Velcro fastener halves 46 are utilized for securing the binder component 42 in place, the fastener halves simply are positioned and forced into frictional engagement with the outer surface of the toe section 19, as best illustrated in FIG. 5. It should now be apparent that the sole portion 16 of the foot covers 10 and 40 selectively are foreshortened simply by repositioning the binder components 14 or 42, as the case may be, relative to the heel tab 30. For example, where the binder component 14 is employed, the binder component is displaced in a direction paralleling, generally, the axis of the foot cover for lengthening or shortening of the sole portion 16, as desired. Similarly, where the binder component 42 is employed the strap 44 is repositioned and resecured to the heel tab 30, employing the Velcro hook portion 48**.

At this juncture it is noted that in some circumstances it may be found desirable to fabricate the strap 44 of the binder component 42 of a decorative, durable material which is suited to be employed with numerous long or short term wear foot covers. In such instances, the strap 44 is, preferably, formed of a decorative material and thus rendered suitable for use as an "ankle bracelet". Moreover, the foot cover 10 is particularly suited for use in instances where a "reversible" capability is desired. For example, it may be found desirable to provide an anti-friction surface on the sole portion of the foot cover in certain circumstances, while other textures having greater frictional characteristics may be more appropriate for other uses. Hence, the foot cover may be fabricated from materials which accommodate a reversal in order to accommodate numerous uses. Of course, the versatility of the Velcro fasteners also makes it possible to employ these fasteners in numerous arrangements in order to further enhance the utility of the foot covers which comprise the improved footwear of the instant invention.

In view of the foregoing, it is believed to be readily apparent that the foot covers embodying the instant invention provide a simple economic, practical and improved footwear characterized by enhanced utility.

Although the invention has been herein shown and described in what are conceived to be the most practical and preferred embodiments, it is recognized that departures may be made therefrom within the scope of the invention, which is not to be limited to the illustrative details disclosed.

Having described my invention, what I claim as new and desire to secure by Letters Patent is:

1. Improved footwear comprising:

A. a flexible cover component for a human foot including a sole portion characterized by forward, central and rearward sections arranged in contiguous, coplanar relation, an upper portion integrally related with the sole portion including a toe section disposed in spaced relation with the plane of the sole portion, a pair of side sections comprising a pair of foldable side tabs extended rearwardly from said toe section, and a heel portion including a foldable heel tab integrally related to the rearward section of the sole portion and projected upwardly therefrom;

B. a flexible binder component for securing the cover component about a human foot comprising a strap having a midsection united with the heel tab in a spaced relation with the rearward section of the sole portion, and a pair of end sections positionable into overlapping relation with the toe section of the upper portion; and C. fastening means for releasably connecting the end portions of the binder component to the toe section of the upper portion, including at least one-half of a Velcro fastener affixed to each end section of the strap of the binder component.

2. The foot cover of claim 1 further comprising adjusting means for varying the width and longitudinal dimension of the cover component.

3. The foot cover of claim 2 wherein said adjusting means includes means for varying the spacing between the strap of the binder component and the rearward section of the sole portion of the cover component, whereby the length of the sole portion of the cover component is varied.

4. The foot cover of claim 3 wherein the means for varying the spacing between the strap of the binder component and the rearward section of the sole portion includes a loop defined in the heel tab for receiving the strap in a captured relationship therewith.

5. The foot cover of claim 3 wherein said means for varying the spacing between the strap of the binder component and the rearward section of the sole portion includes at least one-halfof a Velcro fastener.

6. The foot cover of claim 5 wherein said cover component is severed from a sheet of stock material selected from a class including Velfoam having a fibrous outer surface adapted to receive in securely mated relation one-half of a Velcro fastener.

7. The foot cover of claim 3 wherein said cover component is severed from a sheet of stock material having surfaces of mutually differing surface characteristics.

* * * * *

UNITED STATES PATENT AND TRADEMARK OFFICE

CERTIFICATE OF CORRECTION

PATENT NO. : 4,136,468

DATED : January 30, 1979

INVENTOR(S) : Dorothy G. Munschy

It is certified that error appears in the above-identified patent and that said Letters Patent are hereby corrected as shown below:

Column 2, line 36, after "configuration.", begin a new paragraph.

Column 4, line 47, delete "couse" and substitute ---course---.

Column 6, line 32, delete "one-halfof" and substitute ---one-half of---.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*